US009361905B2

(12) United States Patent
Tsunoda et al.

(10) Patent No.: US 9,361,905 B2
(45) Date of Patent: Jun. 7, 2016

(54) VOICE DATA PLAYBACK SPEED CONVERSION METHOD AND VOICE DATA PLAYBACK SPEED CONVERSION DEVICE

(71) Applicant: Shinano Kenshi Kabushiki Kaisha, Ueda-shi, Nagano (JP)

(72) Inventors: Shoji Tsunoda, Ueda (JP); Tatsuo Nishizawa, Ueda (JP)

(73) Assignee: SHINANO KENSHI KABUSHIKI KAISHA, Ueda-Shi, Nagano (JP)

( * ) Notice: Subject to any disclaimer, the term of this patent is extended or adjusted under 35 U.S.C. 154(b) by 0 days.

(21) Appl. No.: 14/763,303

(22) PCT Filed: Jan. 21, 2014

(86) PCT No.: PCT/JP2014/051042
§ 371 (c)(1),
(2) Date: Jul. 24, 2015

(87) PCT Pub. No.: WO2014/115696
PCT Pub. Date: Jul. 31, 2014

(65) Prior Publication Data

US 2015/0371660 A1 Dec. 24, 2015

(30) Foreign Application Priority Data

Jan. 28, 2013 (JP) ..... 2013-013628

(51) Int. Cl.

| | |
|---|---|
| ***G10L 21/00*** | (2013.01) |
| ***G10L 21/047*** | (2013.01) |
| ***G10L 21/049*** | (2013.01) |
| ***G10L 25/09*** | (2013.01) |
| ***G10L 25/27*** | (2013.01) |
| *G10L 19/00* | (2013.01) |

(52) U.S. Cl.
CPC ..... *G10L 21/047* (2013.01); *G10L 21/049* (2013.01); *G10L 25/09* (2013.01); *G10L 25/27* (2013.01)

(58) Field of Classification Search
CPC ..... G10L 21/047; G10L 21/049; G10L 25/09; G10L 25/27
USPC ..... 704/205, 206, 213, 216, 217, 237
See application file for complete search history.

(56) References Cited

U.S. PATENT DOCUMENTS

2011/0224990 A1 9/2011 Hosokawa

FOREIGN PATENT DOCUMENTS

| | | |
|---|---|---|
| JP | S60-158500 | 8/1985 |
| JP | S62-183500 | 8/1987 |

(Continued)

OTHER PUBLICATIONS

International Search Report for PCT/JP2014/051042 dated Apr. 17, 2014.

*Primary Examiner* — Thierry L Pham
(74) *Attorney, Agent, or Firm* — Stephen J. Weyer, Esq.; Stites & Harbison, PLLC.

(57) ABSTRACT

The present invention addresses the problems of enabling a process of converting voice data playback speed even in a voice data playback device alone. The solution is a voice data playback speed conversion method and a voice data playback speed conversion device, comprising: a step of setting a reference zero cross point from any arbitrary zero cross point; a step of selecting a zero cross point temporally after the reference zero cross point within a first predetermined time range; a step of calculating a reference correlation function in a waveform from the reference zero cross point until a second predetermined time; and a step of calculating a correlation function in a waveform from a plurality of previously selected zero cross points until the second predetermined time, wherein a second reference zero cross point is the zero cross point of the waveform having a correlation function in which a concordance rate of the correlation value between the reference correlation function and the correlation function is the highest value, the difference between the reference zero cross point and the second reference zero cross point is calculated as a basic cycle, and the expansion and contraction of voice data is executed in basic cycle units so as to perform a process of converting the playback speed of the voice data.

2 Claims, 11 Drawing Sheets

(56) References Cited

FOREIGN PATENT DOCUMENTS

| | | |
|---|---|---|
| JP | 9-198092 | 7/1997 |
| JP | 10-187188 | 7/1998 |
| JP | 2002-313015 | 10/2002 |
| JP | 2006-227110 | 8/2006 |
| JP | 2007-94004 | 4/2007 |
| JP | 2008-20870 | 1/2008 |
| JP | 2009042573 | 2/2009 |

FIG.8

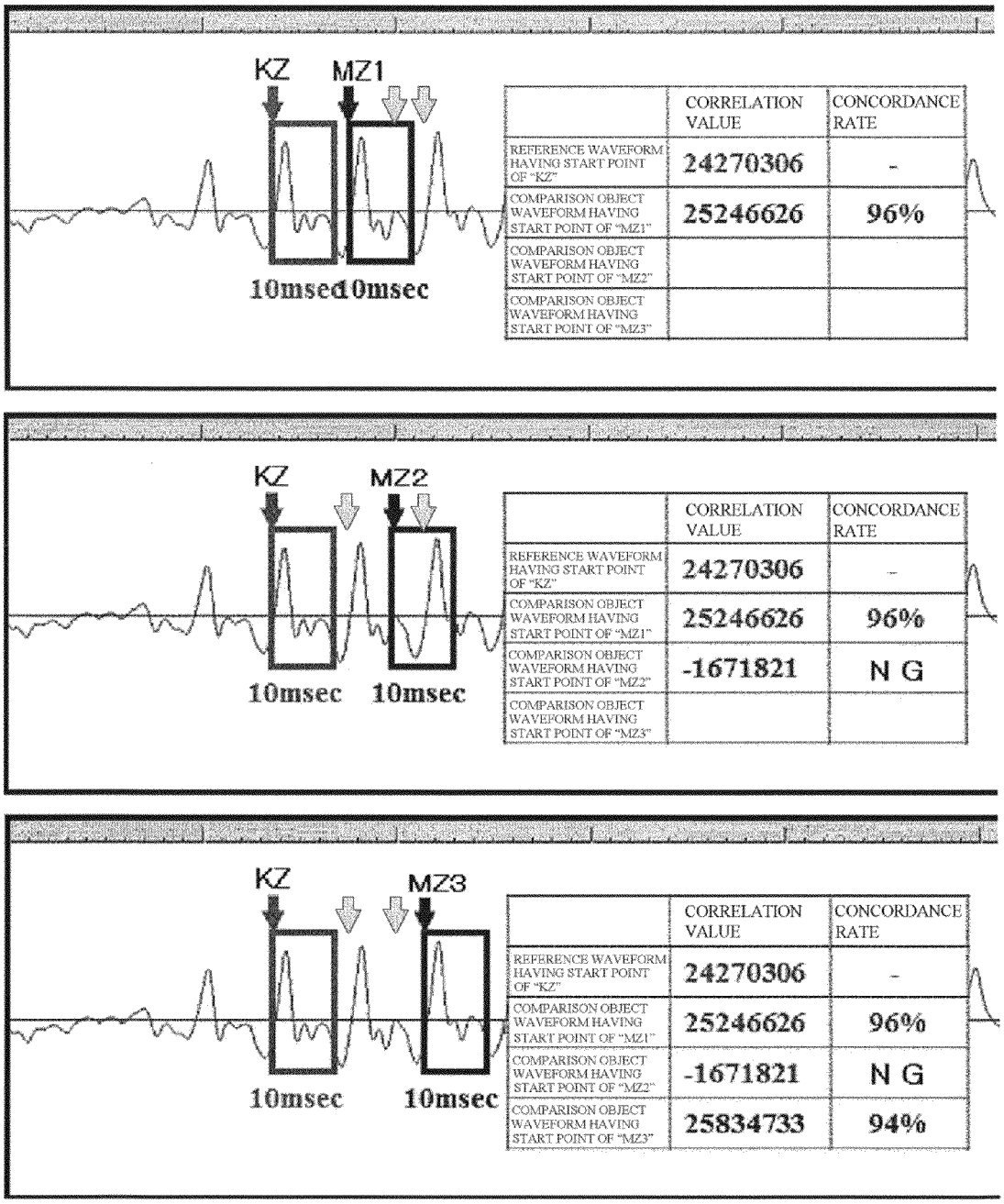

| | CORRELATION VALUE | CONCORDANCE RATE |
|---|---|---|
| REFERENCE WAVEFORM HAVING START POINT OF "KZ" | 24270306 | - |
| COMPARISON OBJECT WAVEFORM HAVING START POINT OF "MZ1" | 25246626 | 96% |
| COMPARISON OBJECT WAVEFORM HAVING START POINT OF "MZ2" | | |
| COMPARISON OBJECT WAVEFORM HAVING START POINT OF "MZ3" | | |

| | CORRELATION VALUE | CONCORDANCE RATE |
|---|---|---|
| REFERENCE WAVEFORM HAVING START POINT OF "KZ" | 24270306 | - |
| COMPARISON OBJECT WAVEFORM HAVING START POINT OF "MZ1" | 25246626 | 96% |
| COMPARISON OBJECT WAVEFORM HAVING START POINT OF "MZ2" | -1671821 | N G |
| COMPARISON OBJECT WAVEFORM HAVING START POINT OF "MZ3" | | |

| | CORRELATION VALUE | CONCORDANCE RATE |
|---|---|---|
| REFERENCE WAVEFORM HAVING START POINT OF "KZ" | 24270306 | - |
| COMPARISON OBJECT WAVEFORM HAVING START POINT OF "MZ1" | 25246626 | 96% |
| COMPARISON OBJECT WAVEFORM HAVING START POINT OF "MZ2" | -1671821 | N G |
| COMPARISON OBJECT WAVEFORM HAVING START POINT OF "MZ3" | 25834733 | 94% |

| | CORRELATION VALUE | CONCORDANCE RATE |
|---|---|---|
| REFERENCE WAVEFORM HAVING START POINT OF "KZ" | 24270306 | - |
| COMPARISON OBJECT WAVEFORM HAVING START POINT OF "MZ1" | 25246626 | 96% |
| COMPARISON OBJECT WAVEFORM HAVING START POINT OF "MZ2" | -1671821 | N G |
| COMPARISON OBJECT WAVEFORM HAVING START POINT OF "MZ3" | 25834733 | 94% |

ORIGINAL VOICE

HALF-SPEED : ONE BLOCK IS CHANGED TO TWO BLOCKS

DOUBLE-SPEED : TWO BLOCKS ARE CHANGED TO ONE BLOCK

VOICE DATA PLAYBACK SPEED CONVERSION METHOD AND VOICE DATA PLAYBACK SPEED CONVERSION DEVICE

FIELD OF TECHNOLOGY

The present invention relates to a voice data playback speed conversion method and a voice data playback speed conversion device.

BACKGROUND TECHNOLOGY

In case of playbacking voice signals recorded in a recording medium, e.g., CD, cassette tape, video tape, a playback speed is sometimes converted from the standard playback speed. For example, in case of listening a prescribed amount of voice in a short time, the playback speed is increased; in case that it is hard to listen voice due to, for example, rapid speech, the playback speed is reduced. To convert the playback speed, a revolution speed of CD or a running speed of a tape is increased or reduced. However, in this playback method, frequency of voice signals read from the recording medium, e.g., CD, is changed according to change of the playback speed, so tone of the voice must be changed and it is hard to listen the changed voice.

Thus, a method for converting a playback speed without changing tone, which comprises a step of dividing original voice signals into a plurality of voice blocks An (n is a natural number) having a predetermined time length and a step of changing combination of the voice blocks, has been proposed. For example, in case of playbacking at double-speed, the voice blocks An are alternately playbacked (e.g., A1-A3-A5 . . . ), so that a playback time can be reduced to a half, and the voice can be playbacked without substantially changing tones because the frequency of the original voice signals are maintained to some extent.

Note that, the voice block is divided by a basic cycle, which is an inverse number of a basic frequency being the lowest frequency of frequency components included in the voice block of the original voice signals. Since the voice signals are always varied, the basic frequency is also varied and the time lengths between the adjacent voice blocks are usually different.

However, if the original voice signals are divided into a plurality of the voice blocks An by an improper time length, the signals of one voice block are discontinued to those of the voice block having the improper time length when combination of the voice blocks is changed to convert the playback speed, so rasping noises will be generated.

In another method, suitable dividing points of the voice blocks An of the original voice signals are defined on the basis of zero cross points of the original voice signals, and connecting points of the voice blocks are the zero cross points, so that noises can be reduced. Technologies for dividing voice signals at zero cross points are disclosed in, for example, Patent Documents 1-3.

PRIOR ART DOCUMENT

Patent Document

Patent Document 1: Japanese Laid-open Patent Publication No. 2002-313015

Patent Document 2: Japanese Laid-open Patent Publication No. 2007-94004

Patent Document 3: Japanese Laid-open Patent Publication No. 2008-20870

SUMMARY OF THE INVENTION

Problems to be Solved by the Invention

To perform the technologies for converting voice data playback speed disclosed in Patent Documents 1-3, calculation amount for extracting voice blocks, which have a suitable time length, from original voice data must be huge. Thus, the process of converting voice data playback speed is usually performed by a high-performance personal computer. However, a portable dedicated playback device, other than a personal computer, is desired, but it is difficult to realize the portable dedicated playback device in terms of battery capacity and thermal design of a high-performance CPU, which has been used in a personal computer, etc. There is a problem that a low-performance CPU takes a long time to perform the process of converting voice data playback speed, so real time processing cannot be performed.

Further, basic frequencies of voices, i.e., human voice of men and women of all ages, are widely varied from 70-350 Hz, so it is difficult to calculate a basic frequency for defining a time length of voice blocks by simply uniformly processing the original voice signals, so complicated calculation is required and processing voice data must be more difficult.

Thus, a first object of the present invention is to provide a voice data playback speed conversion method and a voice data playback speed conversion device, which are capable of enabling a process of converting voice data playback speed even in a voice data playback device having a low-performance CPU.

A second object of the present invention is to provide a voice data playback speed conversion method and a voice data playback speed conversion device, which is capable of highly reducing deterioration of voice data, by suitably calculating basic cycles of the voice data, when the voice data playback speed is converted.

Means for Solving the Problems

The inventor of the present invention has studied and conceived the following structures.

Namely, the voice data playback speed conversion method for converting voice data playback speed comprises: a step of removing DC components, wherein DC components of original voice data being a playback object are removed; a step of extracting basic voice signals constituted by a basic frequency of the voice data, from which DC components have been removed, by setting a cutoff frequency at an intermediate value of the basic frequency and low-pass filtering so as to extract the basic frequency; a step of extracting rising zero cross points of the basic voice signals; a step of setting a reference zero cross point, which is an arbitrary reference zero cross point selected from the rising zero cross points; a step of selecting a plurality of the rising zero cross points temporally after the reference zero cross point within a first predetermined time range; a step of selecting a reference waveform temporally after the reference zero cross point until a second predetermined time; a step of selecting comparison object waveforms from each of the zero cross points, which has been selected in said step of selecting the rising zero cross points, until the second predetermined time; a step of calculating an autocorrelation value between the reference waveform and the reference waveform by using a correlation function; a step of calculating correlation values between the reference waveform and the comparison object waveforms by using a correlation function; a step of calculating voice blocks each of which is segmented by a start point of the voice data and an end point thereof, wherein the autocorrelation value is compared with the correlation values, the zero cross point of the comparison object waveform which is used for calculating the correlation value whose concordance rate with respect to the autocorrelation value is highest is defined as a second reference zero cross point, the start point of the voice data corresponds to the reference zero cross point, and the end point of the voice data corresponds to the second reference zero cross point; and a step of expanding and contracting the voice data in basic cycle units so as to convert the playback speed of the voice data.

With this method, calculation amount for converting the playback speed of the voice data can be highly reduced, so that the process of converting voice data playback speed can be performed even in a voice data playback device alone. Further, the voice blocks, which are basic units of the voice data, can be always correctly extracted when the process of converting the playback speed of the voice data is performed, so that playback quality of the voice data after converting the playback speed can be made significantly higher than ever before.

The voice data playback speed conversion device for converting voice data playback speed comprises: means for removing DC components, wherein DC components of original voice data of being a playback object are removed; means for extracting basic voice signals constituted by a basic frequency of the original voice data, from which DC components have been removed, by setting a cutoff frequency at an intermediate value of the basic frequency and low-pass filtering so as to extract the basic frequency; means for extracting rising zero cross points of the basic voice signals; means for setting a reference zero cross point, which is an arbitrary reference zero cross point selected from the rising zero cross points; means for selecting a plurality of the rising zero cross points temporally after the reference zero cross point within a first predetermined time range; means for selecting a reference waveform from the reference zero cross point until a second predetermined time; means for selecting comparison object waveforms from each of the zero cross points, which has been selected by the means for selecting the rising zero cross points, until the second predetermined time; means for calculating an autocorrelation value between the reference waveform and the reference waveform by using a correlation function; means for calculating correlation values between the reference waveform and the comparison object waveforms by using a correlation function; means for calculating voice blocks each of which is segmented by a start point of the voice data and an end point thereof, wherein the autocorrelation value is compared with the correlation values, the zero cross point of the comparison object waveform which is used for calculating the correlation value whose concordance rate with respect to the autocorrelation value is highest is defined as a second reference zero cross point, the start point of the voice data corresponds to the reference zero cross point, and the end point of the voice data corresponds to the second reference zero cross point; and means for expanding and contracting the voice data in basic cycle units so as to convert the playback speed of the voice data.

With this structure, calculation amount for converting the playback speed of the voice data can be highly reduced, so that the process of converting voice data playback speed can be performed even in a voice data playback device alone. Further, the voice blocks, which are basic units of the voice data, can be always correctly extracted when the process of converting the playback speed of the voice data is performed, so that playback quality of the voice data after converting the playback speed can be made significantly higher than that of the conventional technologies.

Effects of the Invention

In the present invention, the calculation amount for converting the playback speed of the voice data can be highly reduced, so that the process of converting the voice data playback speed can be performed even in the voice data playback device alone. Further, the voice blocks, which are the basic units of the voice data, can be always correctly extracted when the process of converting the playback speed of the voice data is performed, so that the conversion of the playback speed of the voice data can be performed, without deteriorating playback quality of the voice data, even in the voice playback device whose performance is much lower than that of a conventional device.

BRIEF DESCRIPTION OF THE DRAWINGS

FIG. 8 shows graphs, in each of which calculation results of correlation degrees between the reference waveform and the comparison object waveforms are shown.

FIG. 11 FIGS. 11A-11C show schematic charts, which show examples of a method for combining the voice blocks.

EMBODIMENTS OF THE INVENTION

Embodiments of a voice data playback device and a voice data playback speed conversion method of the present invention will now be described in detail with reference to the accompanying drawings.

Figure 1:
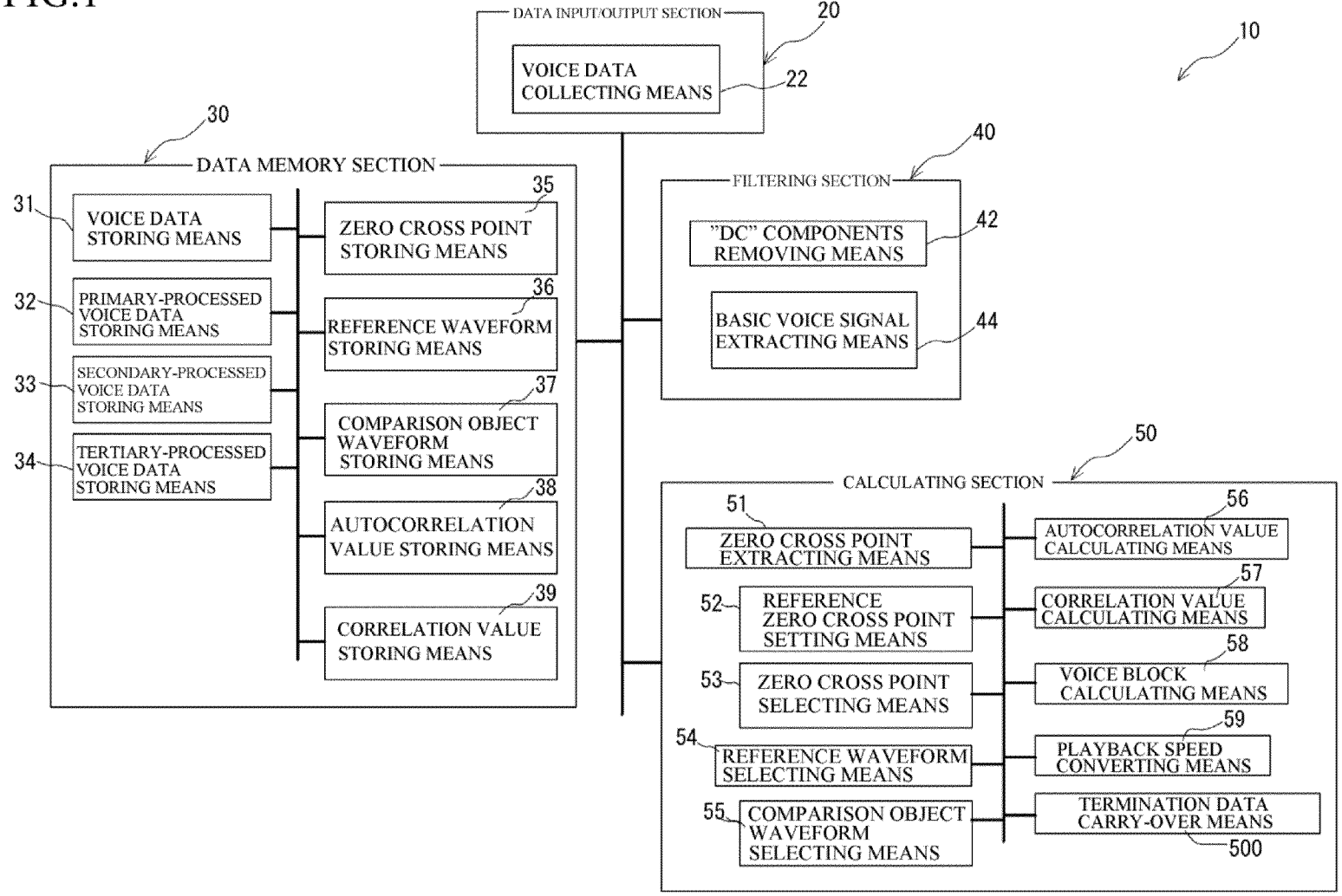
FIG. 1 is a block diagram showing a schematic structure of a voice data playback device relating to an embodiment.

As shown in FIG. 1, a voice data playback device 10 comprises: a data input/output section 20 for inputting and outputting various types of voice data; a data memory section 30 for storing the data sent from the data input/output section 20; a filtering section 40 for filtering the data stored in the data memory section 30; and a calculating section 50 for performing various types of calculation of the voice data filtered by the filtering section 40.

Figure 2:
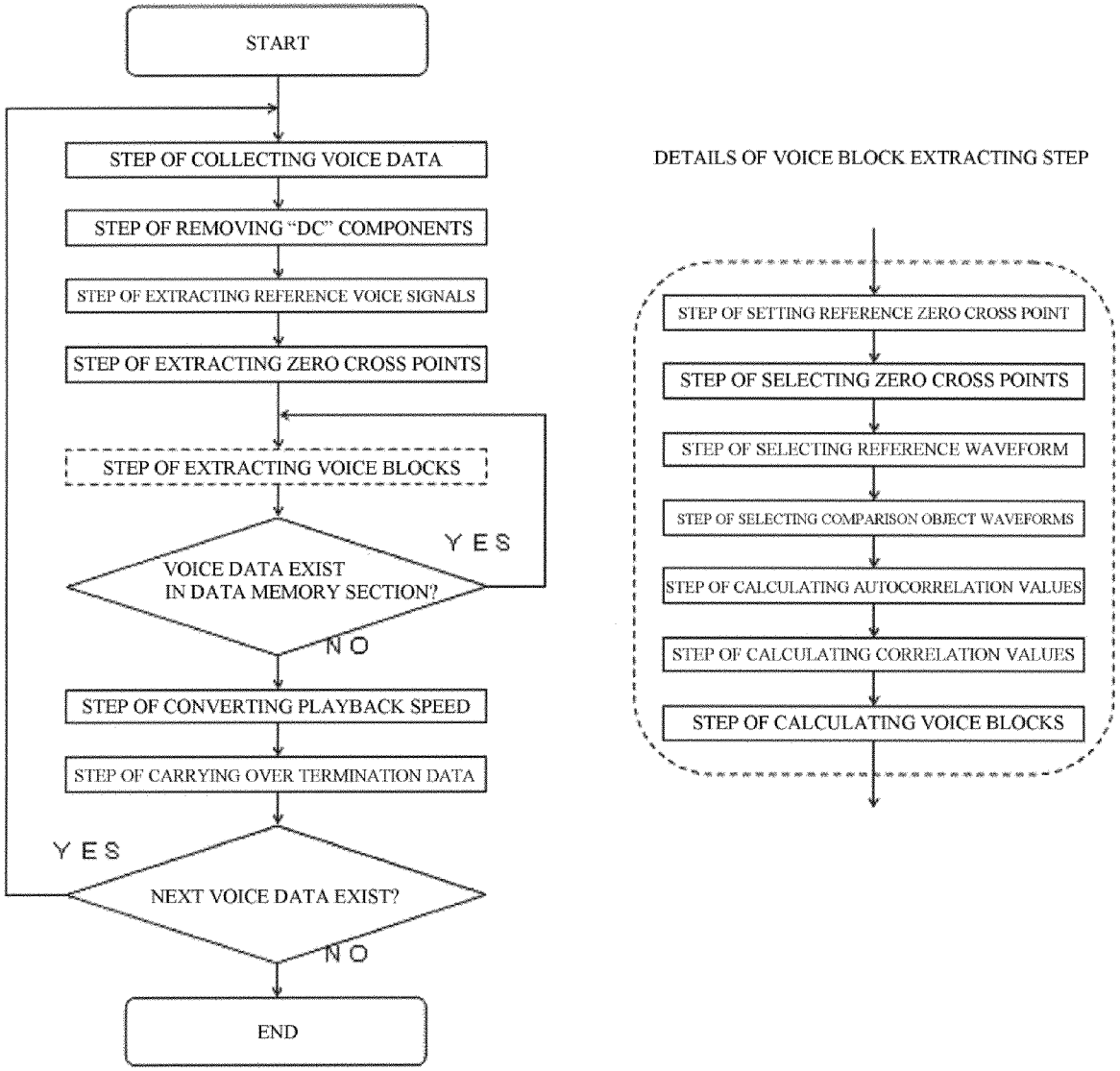
FIG. 2 is a flow chart showing a process of a voice data playback speed conversion method of the embodiment.

A structure of each of the sections of the voice data playback device 10 and a processing flow of the method for converting playback speed of the voice data collected by the data input/output section 20 will be explained, in parallel, with reference to FIGS. 1 and 2. In the present embodiment, the voice data are contents of a book recorded on the basis of DAISY (Digital Accessible Information SYstem)-standard and used by the visually impaired for enjoying the book, but the voice data are not limited to the DAISY-standardized data in the present invention, so the device and the method can be applied to, for example, ordinary digital books.

Firstly, the voice data playback device 10 collects the voice data of 100 msec by voice data collecting means 22 of the data input/output section 20, the collected data are stored in the data memory section 30 (a step of collecting voice data). Namely, the data are buffering-inputted in the unit time of 100 msec. In the second or later voice data collecting step, if a part of the voice data collected in the previous data collecting step are unprocessed and left in holdover data storing means 39, the left voice data are added to a head of the voice data collected in the current data collecting step and stored together. The voice data may be collected from a recording medium, e.g., optical disk, semiconductor memory, or through a network, etc.

The voice data are stored in voice data storing means 31 of the data memory section 30, as original data (original voice data), in a state where the voice data are stored with lapsed time data from a head of the voice data.

Figure 3:
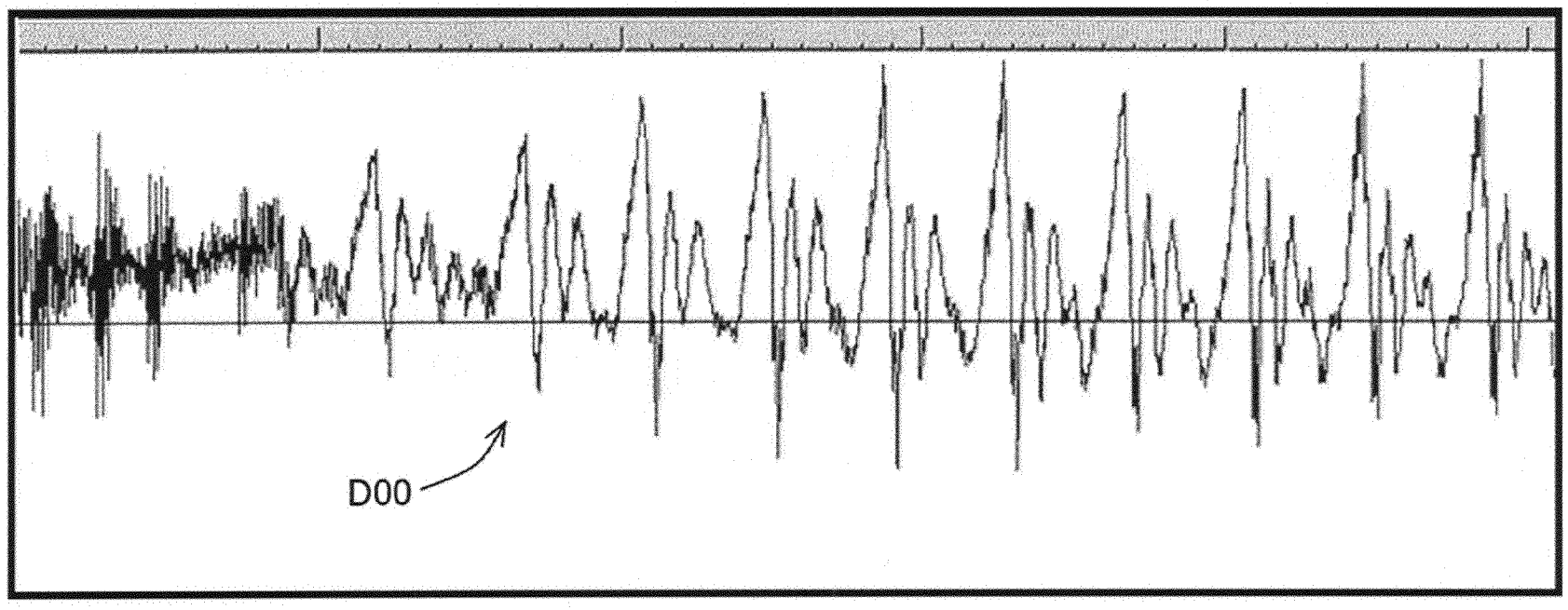
FIG. 3 is a graph showing a waveform of original voice data.

A waveform of the original voice data stored in the voice data storing means 31 is shown in FIG. 3. In FIG. 3, as described above, a time length between a start end and a terminal end of a horizontal axis is about 100 msec. In each of graphs shown in FIG. 4 and the following drawings, a time length between a start end and a terminal end of a horizontal axis is equal to that of FIG. 3.

The original voice data D00 shown in FIG. 3 sometimes include DC components (direct current components), so DC components are removed by DC component removing means 42 of the filtering section 40 (a step of removing DC components). For example, a high-pass filter whose cutoff frequency is 10 Hz may be used as the DC component removing means 42. A graph of primary-processed voice data D01, which is processed by removing DC components from the original voice data D00, is shown in FIG. 4.

The primary-processed voice data D01, which has been obtained by the above described manner, are stored in primary-processed voice data storing means 32 of the data memory section 30 in a state where the processed voice data are stored with lapsed time data from the beginning of the data collection.

Figure 4:
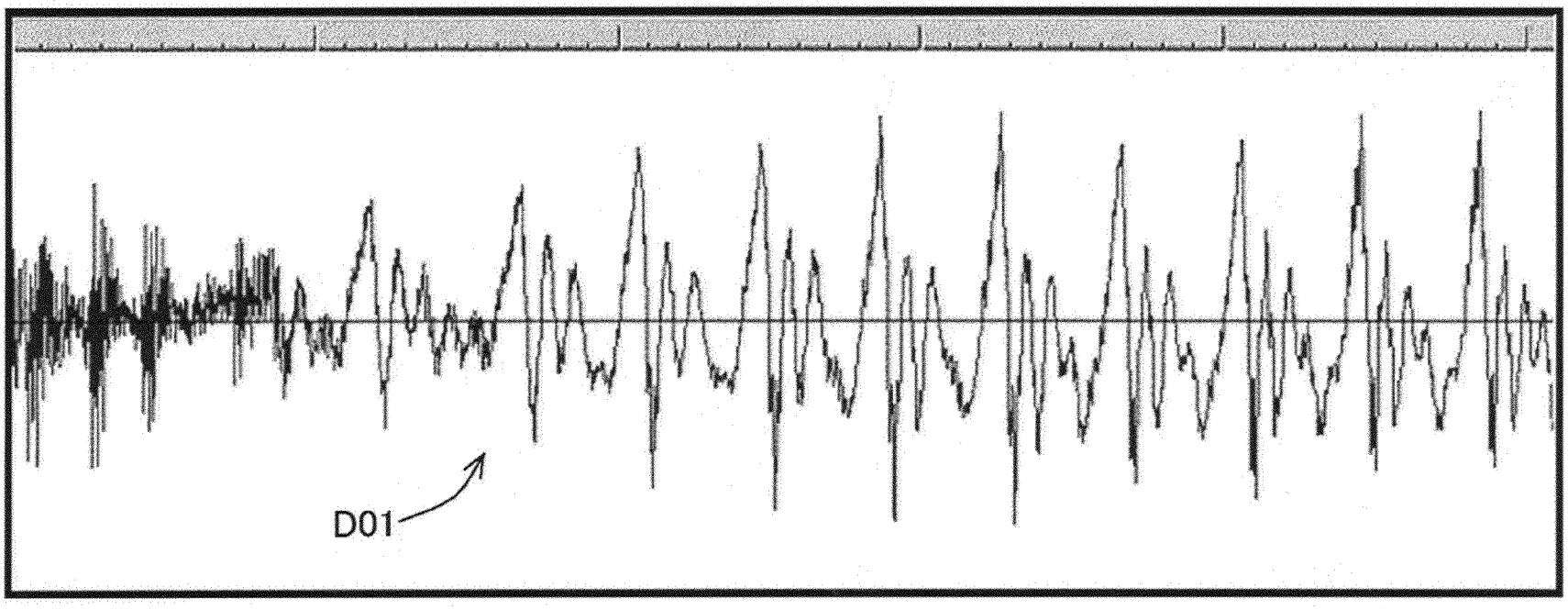
FIG. 4 is a graph showing a waveform, which is processed by removing DC components from the voice data shown in FIG. 3.

Since the primary-processed voice data D01 shown in FIG. 4 include high-frequency components which are exempt from the extraction, it is difficult to extract voice blocks, which are units of basic data of the voice data, from the primary-processed voice data D01. Thus, it is necessary to easily extract the voice blocks from the original voice data D00 by using the primary-processed voice data D01 shown in FIG. 4. Concretely, high-frequency components are removed by basic voice signal extracting means 44 of the filtering section 40 (a step of extracting basic voice signals). In the present embodiment, a low-pass filter whose cutoff frequency is 200 Hz is used as the basic voice signal extracting means 44. A main component of the voice data is human voice, an ordinary basic frequency of male voice is 70-200 Hz and those of female voice and child voice are 150-300 Hz, so the cutoff frequency is selected, with considering high-frequency attenuation characteristics of the filter, at 200 Hz, which is an approximate intermediate value. By using the low-pass filter, the primary-processed voice data D01 are low-pass filtered, so that secondary-processed voice data D02 can be obtained.

Figure 5:
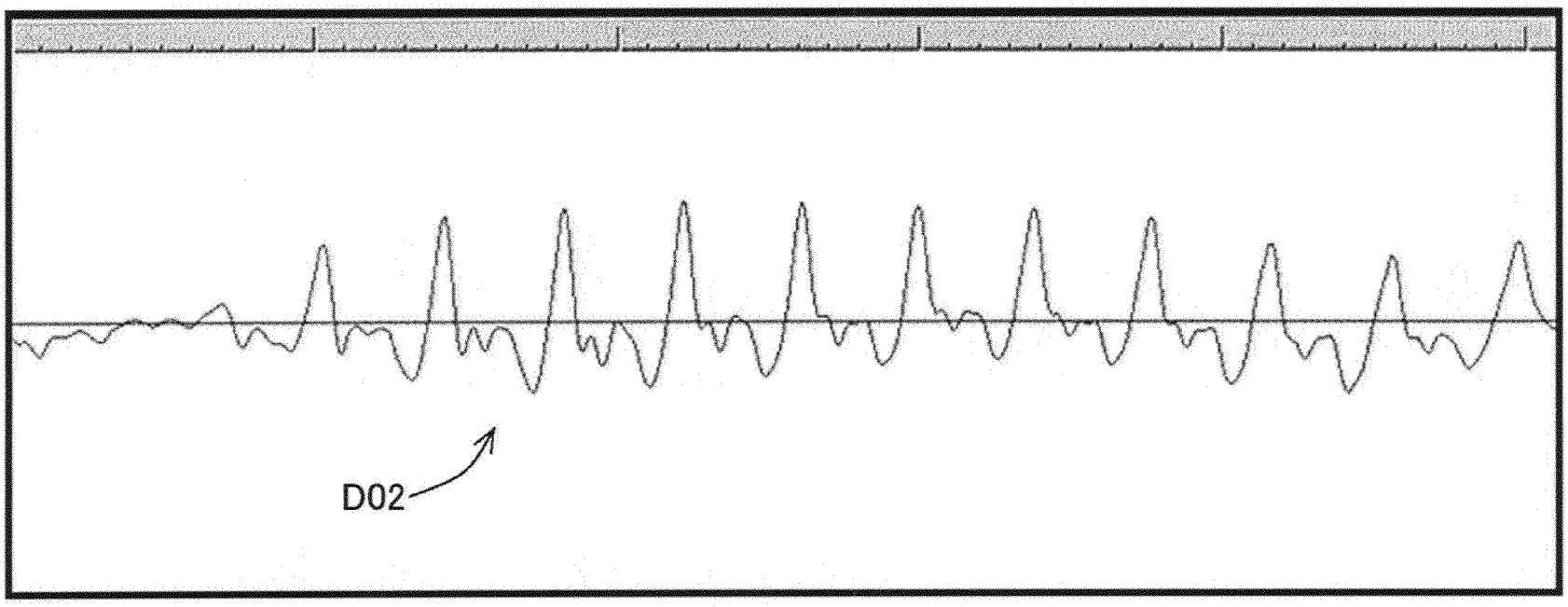
FIG. 5 is a graph showing a waveform of the voice data, which is processed by low-pass filtering the voice data shown in FIG. 4 with a cutoff frequency.

The waveform (graph) of the secondary-processed voice data D02, in which the DC components have been removed by the low-pass filter, is shown in FIG. 5.

By performing the low-pass filtering, the secondary-processed voice data D02, which have been processed (filtered) by removing the exempted frequency components, are stored, in secondary-processed voice data storing means 33 of the data memory section 30, with the lapsed time data from the head of the voice data. In this step, the primary-processed voice data stored in the primary-processed voice data storing means 32 may be deleted after applying a high-pass filter.

Next, rising zero cross points, at each of which a value of the graph shown in FIG. 5 is changed from a negative value to a positive value, are extracted by zero cross point extracting means 51 of the calculating section 50 (a step of extracting zero cross points). In the step of extracting zero cross points of the present embodiment, the zero cross points are extracted under the following rules.

Firstly, in the graph of the secondary-processed voice data D02, the graph always begins from the zero cross point, so a position of the head of the data is basically extracted as first zero cross point.

In the graph of the secondary-processed voice data D02 shown in FIG. 5, even if a zero cross point is found, in a waveform whose amplitude, i.e., a value of a vertical axis, is −42 dB or less, after the previous zero cross point, such point is not regarded as the zero cross point; in case that a zero cross point is found in a waveform whose amplitude, i.e., a value of the vertical axis, is more than −42 dB, such point is extracted as the zero cross point of a sound block. In the graph, a slight waveform exists in a part called a silent part, so the threshold value of the amplitude, i.e., −42 dB, is set so as not to incorrectly extract zero cross points in the silent part of the waveform. On the other hand, in case that the amplitude of the graph is more than −42 dB even in one sample, the zero cross point subsequently firstly found is extracted, and a part from the previous zero cross point to such zero cross point currently found is treated as the sound block.

Further, in case that the amplitude of −42 dB or less is continued for 10 msec (441 samples) in the graph, such part is regarded as a silent block and segmented at an end point even if the end point is not a zero cross point. By segmenting the silent part by every 10 msec, a length of the sound blocks is approximately equal to that of the silent blocks, so that block combination processing, etc. of the voice data can be easily performed.

There are amplitudes of more than −42 dB in the graph, but if no zero cross points exist within 20 msec (882 samples), the part is regarded as the silent block and segmented at an end point even if the end point is not a zero cross point. Even if sound exists in the graph, its waveform having a cycle of 20 msec or more is considered as a back noise which could not be removed by the filtering process.

In the present embodiment, the sound blocks and the silent blocks basically have the same time length, so the above described voice data of the exceptional waveform are also segmented by 20 msec and regarded as the silent block. A first zero cross point found after such silent block is regarded as a rest part of the segmented block for easily treating data and extracted as a zero cross point of the silent block. Namely, in this case, even if the amplitude of the graph is −42 dB or less, the zero cross point is exceptionally extracted.

Further, in case that a zero cross point is found, immediately after the silent block, in a waveform whose amplitude is more than −42 dB, the zero cross point is segmented into the silent block and the sound block and extracted. This rule is applied when satisfying the following two conditions: a new zero cross point having amplitude of −42 dB is found after the zero cross point segmenting the silent block; and at least one zero cross point, which is not extracted due to amplitude of less than −42 dB, exists between the two zero cross points. More precisely, the silent block is terminated at the previously extracted zero cross point, and the currently found zero cross point is extracted as the sound block. Namely, two zero cross points are extracted. This manner is performed to always start the sound block from the zero cross point.

In the present embodiment, the threshold value of the amplitude of the graph, e.g., −42 dB, is set so as not to incorrectly extract zero cross points of the waveform in the silent parts, i.e., silent blocks, but the threshold value is not limited to −42 dB. Other threshold values may be used according to characteristics of voice data.

Figure 6:
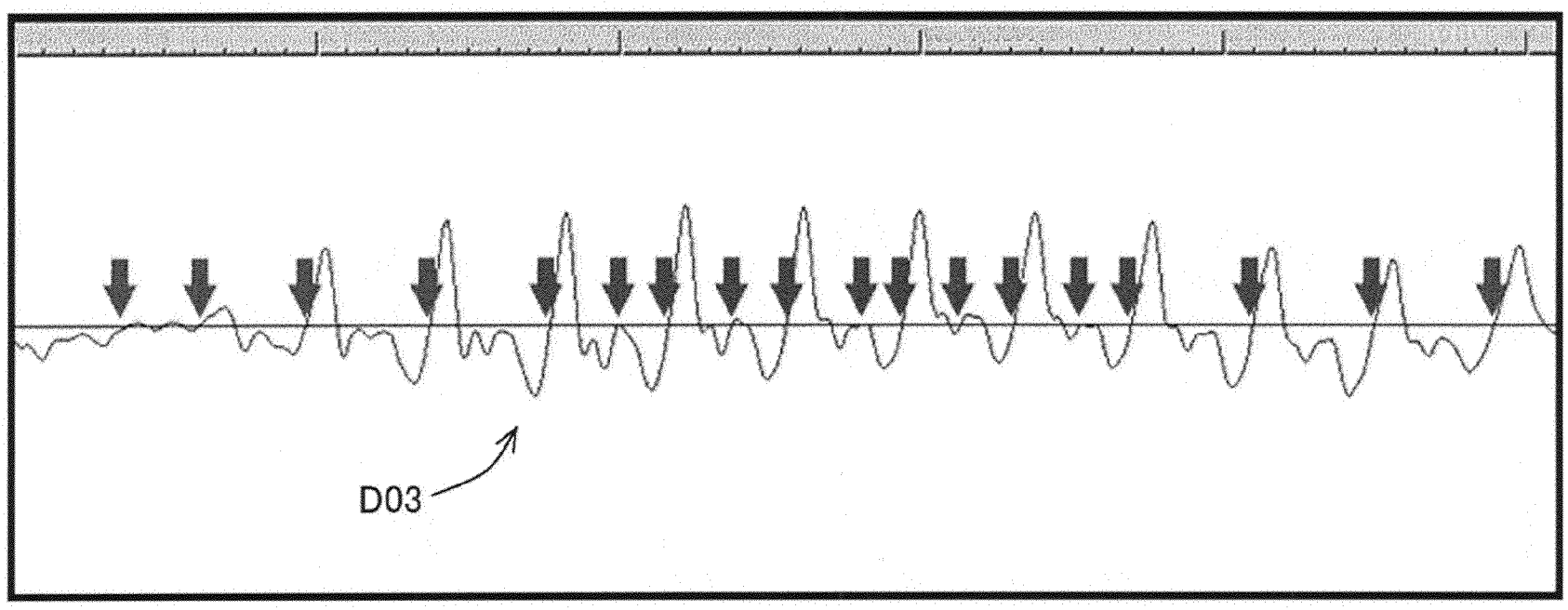
FIG. 6 is a graph showing a waveform of the voice data, in which rising zero cross points, which are extracted from the graph of the voice data shown in FIG. 5, are indicated by arrows.
Figure 7:
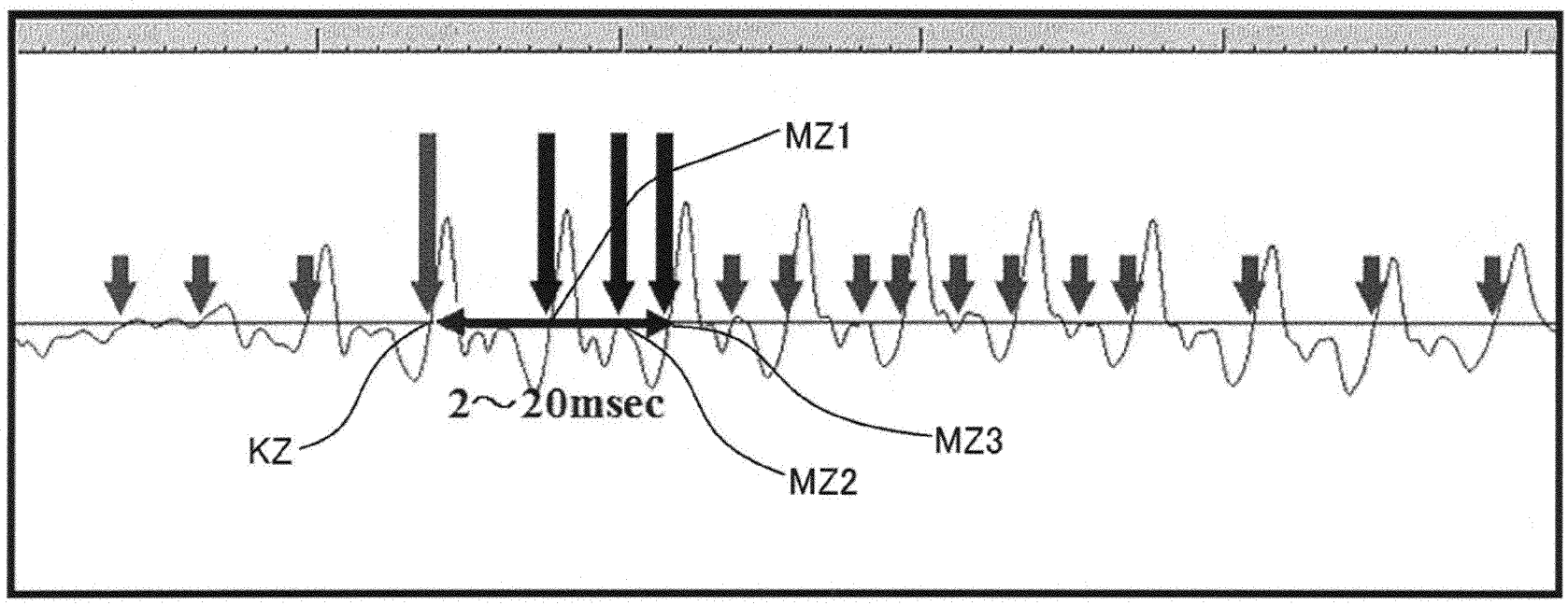
FIG. 7 is a graph showing a waveform of the voice data, in which start points of a reference waveform and comparison object waveforms are indicated.

The extracted rising zero cross points are shown in FIG. 6. In FIG. 6, arrows indicate the rising zero cross points, which are extracted by the above described manner with the zero cross point extracting means 51. The zero cross point extracting means 51 also extracts time data at the points indicated by the arrows shown in FIG. 6.

Tertiary-processed voice data D03, in which the DC components have been removed, the low-pass filtering has been performed and the rising zero cross points have been extracted, are stored in tertiary-processed voice data storing means 34 of the data memory section 30 in a state where the voice data are stored with lapsed time data from the head of the voice data. In the tertiary-processed voice data storing means 34, the time data at the arrowed points shown in FIG. 6 are stored with the lapsed time data from the head of the voice data.

In this step, the voice data (the primary-processed voice data and/or the secondary-processed voice data) stored in the primary-processed voice data storing means 32 and/or the secondary-processed voice data storing means 33 may be deleted.

Next, the first zero cross point of the rising zero cross points shown in FIG. 6 is set as a reference position by reference zero cross point setting means 52 of the calculating section 50 (a step of setting the reference zero cross point). The reference zero cross point KZ, which has been set as the reference position, is stored in zero cross point storing means 35 of the data memory section 30 with time data.

After setting the reference zero cross point KZ, a plurality of the rising zero cross points are selected temporally after the reference zero cross point KZ, within a first predetermined time range, by zero cross point selecting means 53 of the calculating section 50 (a step of selecting zero cross points).

Considering calculation amount of data handled and reliability of calculation results, the first predetermined time range is defined as, for example, 2-20 msec. As described above, ordinary basic frequency of human voice is 70-350 Hz, and one cycle corresponding to said frequency is about 2.86-14.29 msec, so the first predetermined time range including a safety margin is 2-20 msec because zero cross points within at least one cycle must be searched.

In the present embodiment, three rising zero cross points which meet the above described conditions are detected. The detected rising zero cross points are stored in the zero cross point storing means 35 of the data memory section 30, as comparative zero cross points MZ1, MZ2 and MZ3 which are start point candidate positions of a second reference zero cross point, with time data as well as the reference zero cross point KZ.

Successively, a waveform is selected temporally after the reference zero cross point KZ within a second predetermined time range, as a reference waveform of the voice data, by reference waveform selecting means 54 of the calculating section 50 (a step of selecting the reference waveform). In the present embodiment, the second predetermined time is 10 msec. Time of at least a half cycle is required for obtaining complete characteristics of the waveform to be used for a waveform comparing process described later, the first predetermined time is defined as 2-20 msec on the basis of the basic frequency of human voice as described above, so the second predetermined time is defined as 10 msec, which is a half of the maximum value of 20 msec, for the same reason.

The selected reference waveform is stored in reference waveform storing means 36 of the data memory section 30.

Next, comparison object waveform selecting means 55 of the calculating section 50 selects waveform data temporally after each of the comparative zero cross points MZ-MZ3 within the second predetermined time range (a step of selecting the comparison object waveforms). The comparison object waveforms selected by the comparison object waveform selecting means 55 are stored, in order of being selected by the comparison object waveform selecting means 55, in comparison object waveform storing means 37 of the data memory section 30.

Next, autocorrelation value calculating means 56 and correlation value calculating means 57 of the calculating section 50 calculate concordance rates of values of functions in which time is variable (concordance rates of correlation values) between the reference waveform and the comparison object waveforms respectively stored in the reference waveform storing means 36 and the comparison object waveform storing means 37, and select the comparison object waveform whose concordance rate is highest. A concrete manner for calculating the concordance rates of function values will be explained.

The autocorrelation value calculating means 56 segments a time axis of the reference waveform into prescribed time ranges by using the reference waveforms (i.e., functions in which time is variable) and performs product-sum calculation of amplitudes corresponding to the segmented time throughout the entire time axis. The result of the product-sum calculation is stored in autocorrelation value storing means 38 of the data memory section 30 as an autocorrelation value (a step of calculating the autocorrelation value and a step of storing the same).

Next, the correlation value calculating means 57 segments time axes of the reference waveform and the comparison object waveforms into prescribed time ranges by using the reference waveform and the comparison object waveforms (i.e., functions in which time is variable) and performs product-sum calculation of amplitudes corresponding to the segmented time ranges throughout the entire time axis. The result of the product-sum calculation is stored in correlation value storing means 39 of the data memory section 30 as an autocorrelation value (a step of calculating the correlation value and a step of storing the same).

Second zero cross point selecting means, not shown, is provided in the calculating section 50, and it calculates percentage of the concordance rate of the correlation values by using the correlation value stored in the correlation value storing means 39 and the autocorrelation value stored in the autocorrelation value storing means 38, and selects the comparison object waveform whose concordance rate is highest from the comparison object waveform storing means 37. In the present embodiment, as shown in FIGS. 8 and 9, the concordance rate of the correlation values of the comparison object waveform 1 is highest, so the comparative zero cross points MZ1, which is a start point of the comparison object waveform 1, is selected as the second reference zero cross point KZ1 (a step of selecting the second reference zero cross point).

As described above, the start point of the reference waveform is limited to the zero cross point, so it is only necessary to calculate the correlation values of the waveforms whose start points are zero cross points, although the correlation values of waveforms which are started from positions of all samples within the first predetermined time range are calculated primarily; therefore, number of execution of correlation functions can be significantly reduced and calculation amount can be significantly reduced. Further, the wave data, whose correlation values will be calculated, have been low-pass filtered, so that the waveforms vary smoothly. Therefore, even if the time length for segmenting waveforms for calculating the correlation values is set relatively long with respect to the time length of one sample and points for performing the product-sum calculation are decimated, the correlation values between the waveforms are mostly not influenced. In the present embodiment, said time length is set about 0.2 msec so as to perform the calculation once every 10 samples, so that the calculation amount can be further reduced.

Figure 9:
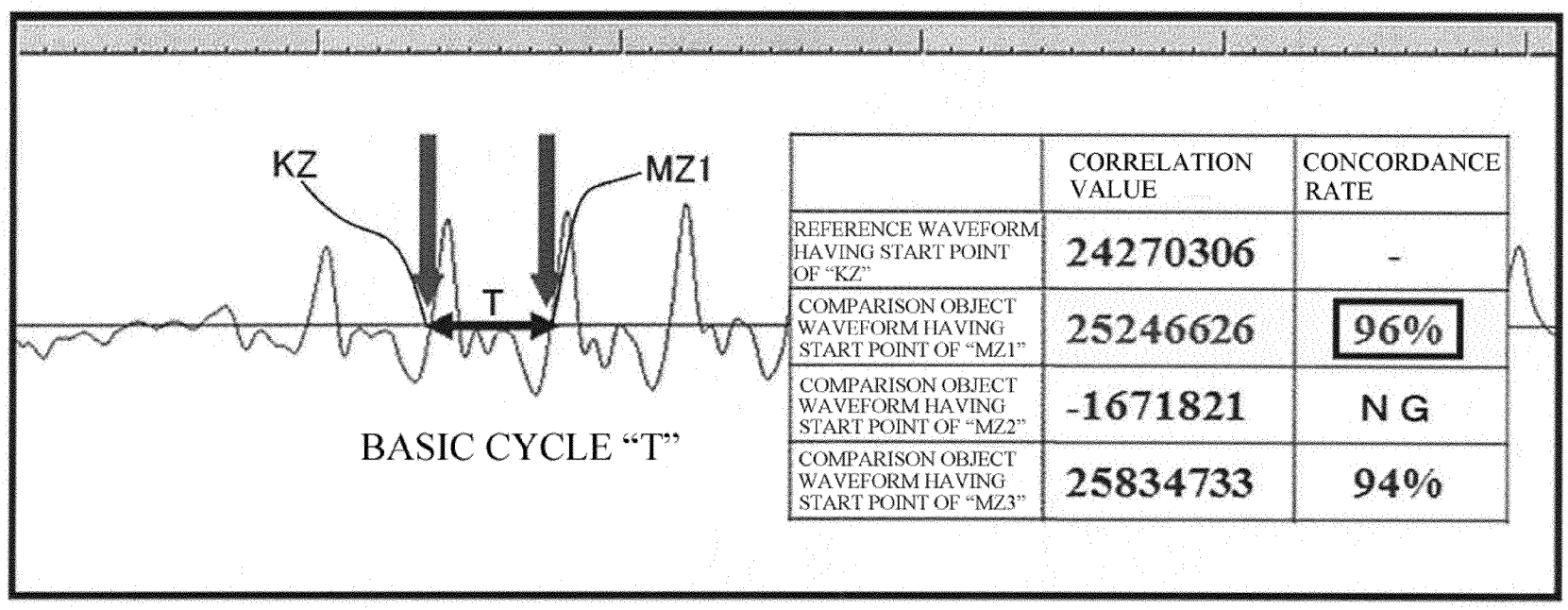
FIG. 9 is a graph showing a waveform of the voice data, in which a rising zero cross point on a start point side of the comparison object waveform, whose correlation degree with respect to the reference waveform is highest, is indicated.

Next, as shown in FIG. 9, voice block calculating means 58 calculates a time difference between the reference zero cross point KZ and the second reference zero cross point KZ1 as a voice block, which is a basic data unit of voice data (a step of calculating the voice blocks). In the following voice blocks, the second reference zero cross point KZ1 acts as the head of the next voice block, i.e., the reference zero cross point KZ thereof, and the new second reference zero cross point KZ1 is defined from such reference zero cross point KZ, so that further following voice blocks can be calculated by the same manner.

Note that, by consecutively segmenting the voice data into voice blocks, odd data which cannot constitute one voice block are sometimes left at the end. A handling manner of the odd data will be explained in a step of carrying over termination data described later.

Figure 10:
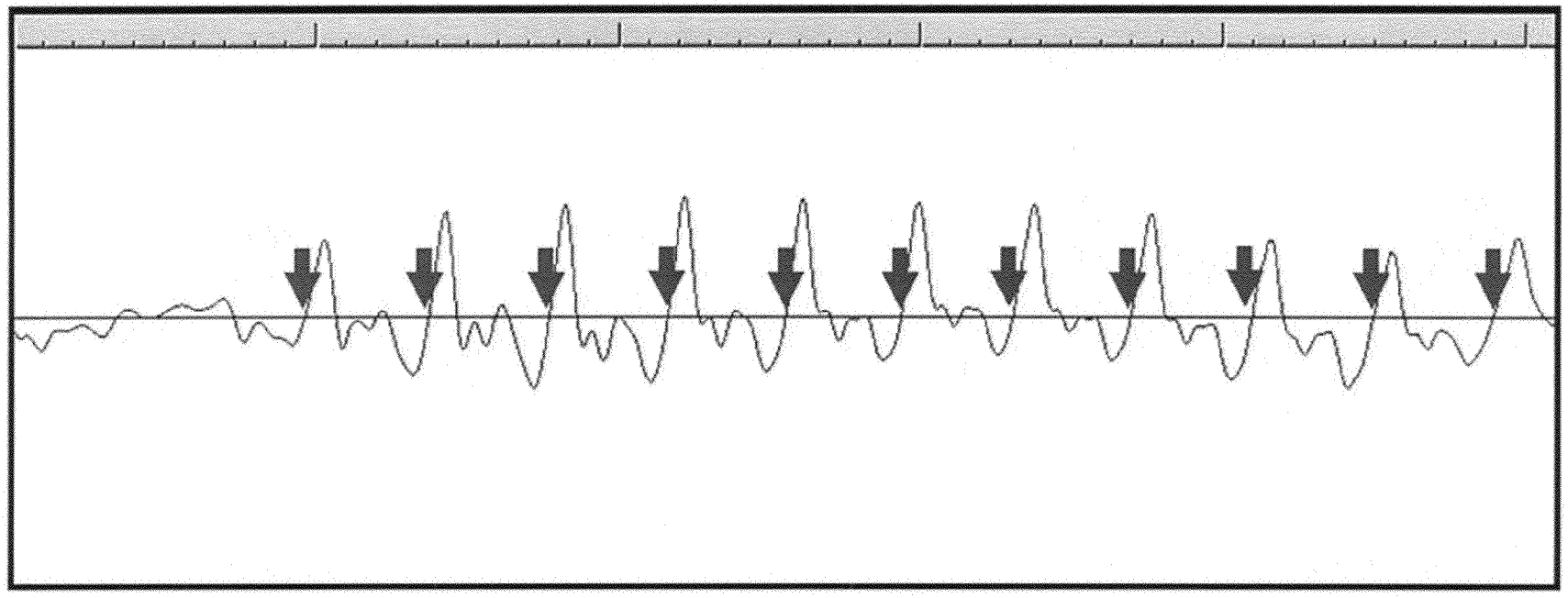
FIG. 10 is a graph showing a waveform of the voice data in which basic voice blocks of the voice data are extracted.

The calculated voice blocks are applied to the graph of FIG. 6, in which the rising zero cross points have been extracted, and the voice data are segmented into the voice blocks by using the first rising zero cross point of FIG. 6 as the reference position, a graph of the segmented data are shown in FIG. 10.

After the voice blocks of the voice data are calculated as described above, playback speed converting means 59 of the calculating section 50 converts a playback speed by using the original voice data stored in the data memory section 30 (a step of converting the playback speed).

A concrete method for converting a playback speed of voice data will be explained.

Figure 11A:
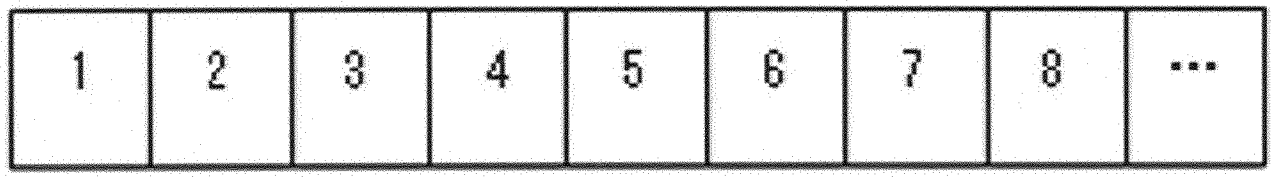
Figure 11B:
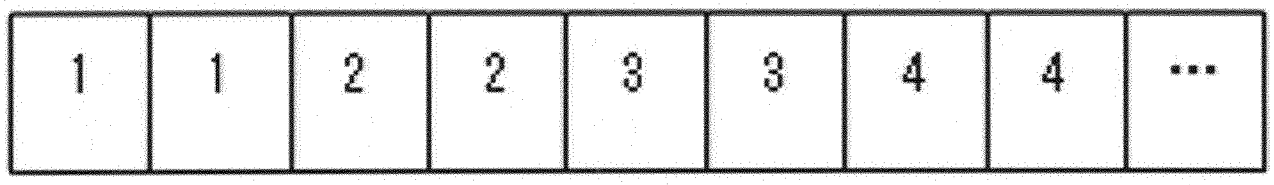
Figure 11C:
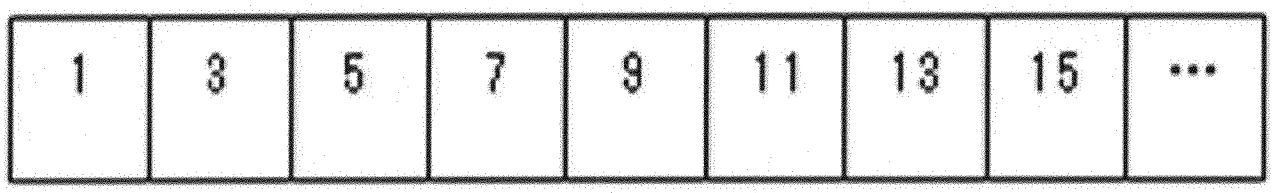

FIGS. 11A-11C are schematic charts, which show an example of a method for combining the voice blocks. FIG. 11A is a schematic chart showing connection of data of voice blocks of the original voice data. FIG. 11B is a schematic chart showing connection of data of the voice blocks, wherein a playback speed is a half-speed. FIG. 11C is a schematic chart showing connection of data of the voice blocks, wherein a playback speed is a double-speed.

The concrete method for converting a playback speed of voice data will be explained with reference to FIGS. 11A-11C, but the method for converting a playback speed of voice data is not limited to the present method and other known converting methods may be applied.

In case of converting the playback speed to the half-speed, as shown in FIG. 11B, one voice block is changed to two voice blocks. Namely, in FIG. 11B, each of the voice blocks are simply repeated twice, so that the playback speed is made half.

In case of converting the playback speed to the double-speed, the voice blocks are combined as shown in FIG. 11C. Namely, one of two successive voice blocks is simply playbacked and the other is not playbacked. By decimating the voice blocks to half, the playback speed can be made double.

As to the silent parts, in case of increasing the playback speed, data whose length is defined according to a speech speed are respectively retrieved from a head side and a rear side of data in the silent part as voice blocks. On the other hand, in case of reducing the playback speed, the voice data are segmented, by a constant minute unit time, into a plurality of minute voice blocks, and the minute voice blocks are combined so as to extend the silent part.

In the present embodiment, the voice data stored in the voice data storing means 31 of the data memory section 30 of the voice data playback device 10 are segmented every 100 msec, but the voice blocks of the voice data are not always have the time length of exactly 100 msec. Therefore, in each of the segments of the voice data, voice data having an insufficient time length which is not capable of constituting one voice block, will exist in an end part of the voice data.

Thus, in the present embodiment, termination data carry-over means 500 of the calculating section 50 retrieves termination data TD, which are included in the end part of each of the voice data and which have insufficient time lengths being not capable of constituting one voice block, and stores said data in the termination data carry-over means 500 (a step of carrying over the termination data).

The termination data TD carried over as described above are added to a head of the voice data of 100 msec to be inputted next time. Since it is clear that the head of the voice data is the start point (zero cross point) of the voice block, the reference zero cross point setting means 52 can unqualifiedly select the head of the voice data as the new reference zero cross point.

The above described steps from the reference zero cross setting step to the voice block calculating step are repeatedly performed until no voice data for calculating a next voice block exist in the data memory section 30, so that calculating the voice blocks included in the voice data stored in the data memory section 30 can be continuously performed.

In case that the next voice data of 100 msec, to which the termination data TD will be carried over, is not inputted, the termination data TD retrieved by the data carry-over means 500 are deleted, and the playback speed conversion process by the voice data playback device 10 is terminated.

In case of employing the above described process too, most voice data included in the termination data TD are a silent part, or very small amount of voice data less than a basic cycle of the voice data even if the termination data TD are a sound part, so that the playback quality after the playback speed conversion process is hardly influenced by deleting the termination data TD.

The playback speed conversion of voice data was performed and the processed voice data were playbacked according to the method of the above described embodiment, the playback speed of the voice data could be suitably converted without changing pitch of voice of a reader. Further, no unnatural noises were included in the processed voice data, and the voice data could be listened comfortably.

By employing the above described voice data playback device 10 and the voice data playback speed conversion method, the voice data playback speed conversion can be suitably performed even in the voice data playback device 10 having a low-performance CPU (the calculating means).

Namely, in the present invention, a high-performance CPU, which is mounted in a personal computer and used for the conventional technologies, need not be mounted in the voice data playback device. Therefore, the present invention is very useful technology for reducing production cost of the voice data playback device.

In the above described embodiment, voice data, especially human voice data, are the object voice data whose playback speed will be converted, so the voice data playback speed conversion can be performed by the voice data playback device 10 only. Voice data having a complicated basic cycle, which are voice data of, for example, recitation with background music, are not target, but such voice data are scarcely included in DAISY book data processed in the above described embodiment, so that no practical problems will occur.

In the above described embodiment, the voice data are segmented by 100 msec and stored, and the reference correlation function and the correlation functions to be compared are set every 10 msec, but the unit time for collecting voice data and the first and second predetermined time ranges used for setting the reference waveform and the comparison object waveforms are not limited to those used in the above described embodiment.

A time range for collecting voice data and the first and second predetermined time ranges used for setting the reference waveform and the comparison object waveforms may be values, which are properly inputted by a user through input means of the data input/output section 20 not shown. In this case, if a maximum and/or a minimum value of the input value is previously defined, voice blocks which are basic units of voice data can be correctly calculated, increasing capacity of data to be calculated can be prevented, and occurring a case where the voice data playback device 10 cannot solely process can be suitably prevented.

What is claimed is:

1. A voice data playback speed conversion method for converting voice data playback speed, comprising:

a step of removing DC components, wherein DC components of original voice data being a playback object are removed;

a step of extracting basic voice signals constituted by a basic frequency of the voice data, from which DC components have been removed, by setting a cutoff frequency at an intermediate value of the basic frequency and low-pass filtering so as to extract the basic frequency;

a step of extracting rising zero cross points of the basic voice signals;

a step of setting a reference zero cross point, which is an arbitrary reference zero cross point selected from the rising zero cross points;

a step of selecting a plurality of the rising zero cross points temporally after the reference zero cross point within a first predetermined time range;

a step of selecting a reference waveform temporally after the reference zero cross point until a second predetermined time;

a step of selecting comparison object waveforms from each of the zero cross points, which has been selected in said step of selecting the rising zero cross points, until the second predetermined time;

a step of calculating an autocorrelation value between the reference waveform and the reference waveform by using a correlation function;

a step of calculating correlation values between the reference waveform and the comparison object waveforms by using a correlation function;

a step of calculating voice blocks each of which is segmented by a start point of the voice data and an end point thereof, wherein the autocorrelation value is compared with the correlation values, the zero cross point of the comparison object waveform which is used for calculating the correlation value whose concordance rate with respect to the autocorrelation value is highest is defined as a second reference zero cross point, the start point of the voice data corresponds to the reference zero cross point, and the end point of the voice data corresponds to the second reference zero cross; and a step of expanding and contracting the voice data in basic cycle units so as to convert the playback speed of the voice data.

2. A voice data playback speed conversion device for converting voice data playback speed, comprising:

means for removing DC components, wherein DC components of original voice data being a playback object are removed;

means for extracting basic voice signals constituted by a basic frequency of the original voice data, from which DC components have been removed, by setting a cutoff frequency at an intermediate value of the basic frequency and low-pass filtering so as to extract the basic frequency;

means for extracting rising zero cross points of the basic voice signals;

means for setting a reference zero cross point, which is an arbitrary zero cross point selected from the rising zero cross points;

means for selecting a plurality of the rising zero cross points temporally after the reference zero cross point within a first predetermined time range;

means for selecting a reference waveform temporally after the reference zero cross point until a second predetermined time;

means for selecting comparison object waveforms from each of the zero cross points, which has been selected by the means for selecting the rising zero cross points, until the second predetermined time;

means for calculating an autocorrelation value between the reference waveform and the reference waveform by using a correlation function;

means for calculating correlation values between the reference waveform and the comparison object waveforms by using a correlation function;

means for calculating voice blocks each of which is segmented by a start point of the voice data and an end point thereof, wherein the autocorrelation value is compared with the correlation values, the zero cross point of the comparison object waveform which is used for calculating the correlation value whose concordance rate with respect to the autocorrelation value is highest is defined as a second reference zero cross point, the start point of the voice data corresponds to the reference zero cross point, and the end point of the voice data corresponds to the second reference zero cross point; and means for expanding and contracting the voice data in basic cycle units so as to convert the playback speed of the voice data.

* * * * *